United States Patent [19]

Rushforth

[11] 4,190,955

[45] Mar. 4, 1980

[54] GOLF TEE AWL AND PIVOTED SHEATH

[76] Inventor: Harold E. Rushforth, 1981 Monument Rd., NW, Canton, Ohio 44709

[21] Appl. No.: 941,286

[22] Filed: Sep. 11, 1978

[51] Int. Cl.[2] ..... B26F 1/00

[52] U.S. Cl. ..... 30/366; 24/3 E; 24/3 F; 24/3 R; 24/81 AD; 30/151; 30/368

[58] Field of Search ..... 30/151, 368, 367, 366, 30/361, 358; 24/3 E, 3 R, 3 F, 81 AD

[56] References Cited

U.S. PATENT DOCUMENTS

| | | | |
|---|---|---|---|
| 1,120,101 | 12/1914 | Spillmann | 24/3 R |
| 1,318,850 | 10/1919 | De Yong | 24/3 E |
| 1,605,195 | 11/1926 | Lewis | 24/3 F |
| 1,873,736 | 8/1932 | Braunlich | 24/3 R |
| 1,999,688 | 4/1935 | Elliott | 24/3 F |
| 2,212,756 | 8/1940 | Stewart | 24/3 R |
| 2,280,304 | 4/1942 | Schauer | 24/3 F |
| 3,497,676 | 2/1970 | Gravatt | 24/3 F |
| 3,988,809 | 11/1976 | Powell et al. | 24/85 R |
| 4,090,298 | 5/1978 | Rushforth | 30/368 |

*Primary Examiner*—Othell M. Simpson
*Assistant Examiner*—J. T. Zatarga
*Attorney, Agent, or Firm*—Paul E. Milliken

[57] ABSTRACT

A golf tee awl for making holes in the ground to make it easier to insert golf tees. The awl has a circular knob-shaped handle with a sharpened shank or spike protruding therefrom and a protective sheath which covers the sharpened shank when the awl is not in use. The sheath has a tubular shank receiving member which is pivotally connected to a clip which fits on the belt of a person using the awl. The tubular member can be rotated to a position with the open end of the member extending upwardly to hold the tee awl or it can be rotated to a position with the open end extending downwardly to make it easier to remove the awl by pulling it downwardly out of the sheath. The sheath and handle are preferably made of plastic and the shank and the clip for the sheath are preferably made of metal.

7 Claims, 7 Drawing Figures

GOLF TEE AWL AND PIVOTED SHEATH

This invention relates to a golf tee awl for making holes in the ground prior to inserting golf tees and a pivoted sheath for holding the awl which can be worn on the belt of a person using the awl.

PRIOR ART

The closest prior art known to applicant is applicant's own prior U.S. Pat. No. 4,090,298 issued May 23, 1978.

OBJECTS OF THE INVENTION

It is a primary object of this invention to improve upon applicant's prior invention in U.S. Pat. No. 4,090,298 by providing a pivoted sheath which is easier to use when inserting and removing the awl from the sheath and by providing an improved clip which is more likely to prevent the sheath from coming dislodged from the belt of a wearer.

Another object of the invention is to provide a sheath and awl combination which will be comfortable when worn by the user.

Another object of the invention is to provide a golf tee hole making device which can be carried on the user's belt without danger of injury from the spike member used to make the holes for the golf tees.

These and other objects of the invention will become more fully apparent as the description proceeds in the following specification and the attached drawings.

STATEMENT OF THE INVENTION

This invention is the combination of a golf tee awl for making holes in the ground for inserting golf tees and a pivoted sheath comprising: an awl having a handle, and a shank having one end connected to the handle and the opposite end being pointed for insertion into the ground, and a sheath comprising; an elongated clip for attachment to the belt of a person using the awl, and a substantially tubular member pivotally attached to the clip, said tubular member being in parallel alignment with the clip and being rotatable about its pivotal connection with the clip from a first position in which the shank receiving end is facing upwardly when the clip is placed on the belt of a person using the awl and sheath to a second position in which the shank receiving end of the tubular member is extending downwardly.

DESCRIPTION OF THE PREFERRED EMBODIMENTS

Figure 1:
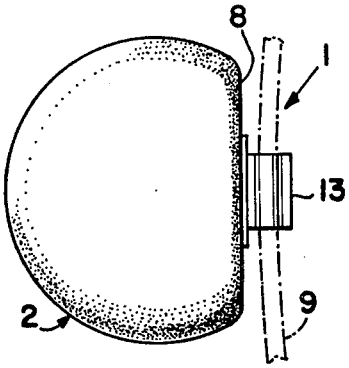
FIG. 1 is a top plan view of the device of the invention.
Figure 3:
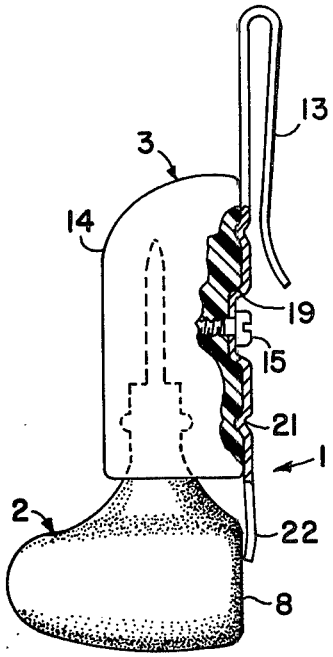
FIG. 3 is a side elevational view similar to FIG. 2 except that the awl retainer portion of the sheath has been rotated about its pivot point to an inverted position with the handle of the awl hanging downwardly.
Figure 2:
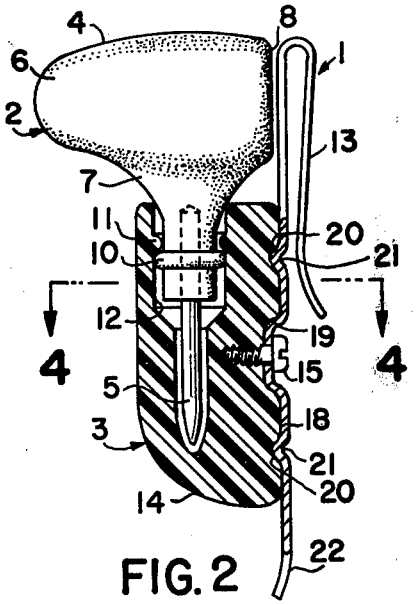
FIG. 2 is a side elevational view of the device of the invention with portions of the sheath broken away to show how the awl fits into the sheath.

Referring now to FIGS. 1 and 2 of the drawings, the entire awl and sheath assembly is indicated by the numeral 1. An awl 2 is removeably mounted in a sheath 3. The awl 2 has a handle 4 made preferably of plastic to which is attached an elongated shank or spike 5 having its free end sharpened to provide easier penetration into the ground. The handle 4 is shaped generally like one type of door knob and has a hand grippable portion 6 of substantially elliptical cross-section which merges with a shank receiving portion 7 which is frustoconical in cross-section. The grippable portion 6 has a truncated portion at one location on the circumference which forms a flat surface 8. The flat surface 8 enables the awl 2 when placed in the sheath 3 to be worn on a belt 9 of a person using the device without discomfort, since the flat surface 8 is aligned with the belt engaging clip 13 and is turned facing the wearer's hip as shown in FIGS. 1 through 3 and FIG. 7. The flat surface 8 permits the operation of the sheath 3 from an upright position as shown in FIG. 2 to an inverted postion as shown in FIG. 3 which will be described later. The flat surface 8 is also useful in preventing the awl 2 from rolling when placed on a surface such as a table top. A radially outwardly facing sheath retaining rib 10 extends around the circumference of the frustoconical portion 7 and cooperatively engages a radially inwardly facing rib 11 located in the axial bore 12 of the sheath 3. As illustrated in FIG. 2 the shank 5 is inserted into the bore 12 a sufficient distance that the rib 10 snaps past the rib 11 on the sheath 3 thereby holding the awl 2 in the sheath 3 when it is suspended upside-down as shown in FIG. 3.

Figure 5:
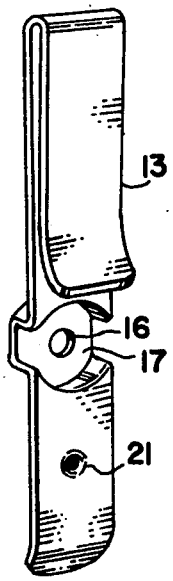
FIG. 5 is a perspective view of the clip of the sheath.
Figure 4:
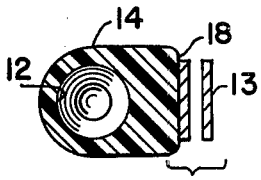
FIG. 4 is a cross-sectional view taken on line 4—4 of FIG. 3.
Figure 7:
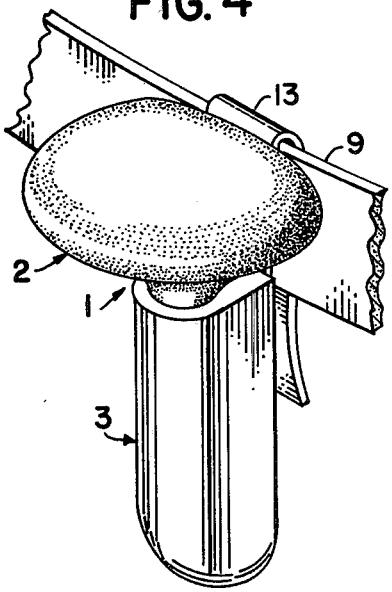
FIG. 7 is a perspective view of the device with the sheath in the upright position for carrying the awl on the belt of a user of the device.
Figure 6:
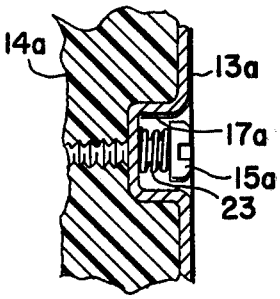
FIG. 6 is a fragmentary enlarged view showing a modified version of the sheath pivot member.

The sheath 3 is comprised of the clip 13 which is preferably stamped from a flat sheet of steel and formed to the shape illustrated in FIG. 5 by convention means which are well known in the metal forming art, and a tubular member 14 preferably molded of plastic with the axial bore 12 as previously described. The clip 13 and the tubular member 14 are pivotally connected together by a screw 15 or other suitable means passing through a hole 16 in an offset portion 17 formed in the clip 13. The tubular member 14 is substantially round in cross-section but has a flat surface 18 extending longitudinally of the member at one location on the circumference thereof. A recess 19 is formed near the longitudinal center of the flat surface 18 for receiving the offset 17 of the clip 13. Equally spaced on either side of the recess 19 are two smaller indentations 20 for receiving a mating pair of dimples or projections 21 formed in the clip 13 on opposite sides of the hole 16. It may be seen that the member 14 is therefore pivotally attached to the clip 13 by the screw 15 and can rotate from the first upright postion as shown in FIGS. 2 and 7 to an inverted or second position as shown in FIG. 3. The two projections 21 on the clip register with the indentations 20 on the member 14 to hold the member 14 in either the first or second position with respect to the clip 13. The member 14 is rotated to the upright position (FIG. 2) for inserting or carrying the awl 2 as shown in FIG. 7 and is rotated to the inverted postion (FIG. 3) so that the awl 2 can be withdrawn from the sheath 3 merely by pulling down on the handle 4. By pulling downward on the awl 2, the sheath and clip 13 are pulled tighter onto the wearer's belt and thereby is not likely to fall off. A lower extension 22 projects below the tubular member 14 when it is in the upright position shown in FIG. 2 to provide a means of holding the clip while rotating the member 14 from the upright to the inverted position FIG. 6 shows another embodiment of the pivotal connection between the clip 13 and member 14 with similar parts bearing similar numerals except with the letter "a" added. The primary difference between the pivot in FIG. 2 and in FIG. 6 is that the offset 17*a* in clip 13*a* is deeper than the offeset 17 and therefore provides room for a spring 23 which holds the clip 13*a* firmly in place against the member 14*a* while permitting rotation of the member 14*a* when it is turned by hand from one position to another. Various other types of pivot can be used without departing from the scope of the invention.

While the dimensions of the invention may vary somewhat, the shank 5 should be long enought to provide a hole which is deep enough to accomodate any standard size golf tee and smaller in diameter than the diameter of the golf tee at the portion that is below ground when the tee is in operative position. Golf tees may vary in diameter from approximately 0.150" (3.81 mm.) to 0.200" (5.08 mm), depending upon whether they are wood or plastic. A good working diameter for the shank is from 0.100" (2.54 mm) to 0.1875" (4.76 mm.). This produces a hole which should hold the tee firmly in the ground. The length of the shank may vary from 1' (25.4 mm.) to 1.75" (44.45 mm.). This range should provide a hole of sufficient depth for any standard size tee.

While for the sake of simplicity it has not been shown in the drawings, some type of fins or other protrusions may be used on the end of the shank 5 which extends into the shank receiving portion 7 of the handle 4, to aid in securly fastening it in the handle. If the handle 4 is plastic molded or cast around the shank 5, it can be attached in a manner similar to that used on plastic screw driver handles. Another alternative would be for the shank to be threaded and screwed into the handle. The method of fastening these two parts together will of course depend upon the materials used.

While for the purpose of illustrating the invention the handle was described as made preferably of plastic, it is obvious that it could be made of metal, rubber or any other suitable material which has the needed physical properties. The same statement can also be made with respect to the sheath and the shank of the device. The shank, must of course, be made from a material which is sufficiently hard that it will not bend or break when being used to penetrate hard ground. These and various modifications can be made herein without departing from the scope of the invention. It should be understood that the term tubular member as used herein to describe a portion of the sheath 3 is not limited to a round tubular member but may be of other shapes so long as it is of a configuration having an axial bore therein receiving the shank of the awl.

I claim:

1. The combination of a golf tee awl for making holes the ground for inserting golf tees and a pivoted sheath comprising:

(A) a handle portion to be held in the hand of the user;

(B) a shank portion having one end thereof attached to the handle portion;

(C) the opposite end of the shank portion having a sharpened point to provide ease of penetration into the ground when pressure is exerted against the handle portion;

(D) the handle portion having at least one flat surface lying in a plane parallel to the longitudinal axis of the handle and shank portion; and (E) a sheath for attachment to the golf tee awl comprising;

(1) a substantially tubular member having an axial receptacle therein for receiving the shank portion;

(2) an elongated clip having a first portion pivotally attached to the exterior of the tubular member in parallel alignment with the axis thereof and a second portion folded over against the first portion, the clip being adapted to receive the belt of a wearer between the first and second portion thereof, (3) the tubular member being rotatable about its pivotal connection with the clip from a first vertical position in which the shank receiving end is facing upwardly when the clip is placed on the belt of a person using the awl and sheath, to a second vertical position in which the shank receiving end of the tubular member is extending downwardly, (4) said tubular member being moved to the first position for receiving and carrying the awl in the sheath, and being moved to the second position for removing the awl from the sheath by pulling downwardly on the awl, and (5) means releasably retaining the tubular member in either the first or second position with respect to the clip.

(6) wherein the means retaining the tubular member in the first or second position is at least one indentation in the surface of the tubular member and a dimpled projection on the first portion of the clip, said indentation being brought into register with the projection when the tubular member is rotated to one of the said positions.

2. The combination as claimed in claim 1 including a screw passing through an opening in the clip and threaded into the tubular member to pivotally connect the tubular member to the clip.

3. The combination as claimed in claim 2 wherein the clip has an offset extending toward the adjacent surface of the tubular member in the location where the pivot screw passes through the clip and the tubular member has a circular recess therein for receiving the offset.

4. The combination as claimed in claim 2 wherein a spring is used in the offset in conjunction with the screw to exert tension on the clip and hold it firmly against the tubular member.

5. The combination as claimed in claim 1 wherein the flat portion of the handle which is parallel to the axis thereof is vertically aligned with the clip to permit rotation of the tubular member with respect to the clip from the first position to the second position.

6. The combination as claimed in claim 1 wherein the lower end of the clip extends downwardly beyond the end of the tubular member to provide a means of gripping the clip when rotating the tubular member about the pivot.

7. The combination of a golf tee awl for making holes in the ground for inserting golf tees and a pivoted sheath comprising:

(A) an awl having;

(1) a handle, and (2) a shank having one end connected to the handle and the opposite end being pointed for insertion into the ground, and (B) a sheath comprising;

(1) an elongated clip for attachment to the belt of a person using the awl, (2) a substantially tubular member pivotally attached to the clip, (3) said tubular member having an axial receptacle therein for receiving the shank, (4) the tubular member being in parallel alignment with the clip and being rotatable about its pivotal connection with the clip from a first vertical position in which the shank receiving end is facing upwardly when the clip is placed on the belt of a person using the awl and sheath to a second vertical position in which the shank receiving end of the tubular member is extending downwardly, and (5) means releasably retaining the tubular member in either the first or second position (6) wherein the means retaining the tubular member in the first or second position is at least one indentation in the surface of the tubular member and a dimpled projection on the first portion of the clip, said indentation being brought into register with the projection when the tubular member is rotated to one of the said positions.

* * * * *